US006499010B1

(12) United States Patent
Faller

(10) Patent No.: US 6,499,010 B1
(45) Date of Patent: Dec. 24, 2002

(54) PERCEPTUAL AUDIO CODER BIT ALLOCATION SCHEME PROVIDING IMPROVED PERCEPTUAL QUALITY CONSISTENCY

(75) Inventor: Christof Faller, Prague (CZ)

(73) Assignee: Agere Systems Inc., Allentown, PA (US)

( * ) Notice: Subject to any disclaimer, the term of this patent is extended or adjusted under 35 U.S.C. 154(b) by 0 days.

(21) Appl. No.: 09/477,314

(22) Filed: Jan. 4, 2000

(51) Int. Cl.[7] ..... G10L 19/02

(52) U.S. Cl. ..... 704/229; 704/219; 704/200.1; 704/230; 704/222

(58) Field of Search ..... 704/201, 200, 704/200.1, 500–504, 219, 220, 226, 229, 214, 228, 227, 230, 222, 223; 375/225, 240.11; 370/389

(56) References Cited

U.S. PATENT DOCUMENTS

| | | | | |
|---|---|---|---|---|
| 5,040,217 A | | 8/1991 | Brandenburg et al. | 381/47 |
| 5,627,938 A | | 5/1997 | Johnston | 395/2.39 |
| 5,649,052 A | * | 7/1997 | Kim | 704/226 |
| 5,777,992 A | * | 7/1998 | Lokhoff | 370/389 |
| 5,848,387 A | * | 12/1998 | Nishiguchi et al. | 704/214 |
| 5,956,674 A | * | 9/1999 | Smyth et al. | 704/200.1 |
| 5,974,380 A | * | 10/1999 | Smyth et al. | 704/201 |
| 5,999,899 A | * | 12/1999 | Robinson | 704/219 |
| 6,098,039 A | | 8/2000 | Nishida | 704/229 |
| 6,108,372 A | * | 8/2000 | Tidemann et al. | 375/225 |

FOREIGN PATENT DOCUMENTS

JP 10035876 2/1998 ..... H03M/7/30

OTHER PUBLICATIONS

Application Ser. No. 09/238136, Filed: Jan. 27, 1999 by D. Sinha and C.–E. W. Sundberg.

* cited by examiner

*Primary Examiner*—Vijay B. Chawan
(74) *Attorney, Agent, or Firm*—Kenneth M. Brown

(57) ABSTRACT

A method (and apparatus) for coding an audio signal, the method comprising the steps of partitioning the audio signal into a sequence of successive frames; calculating one or more noise thresholds for each of a plurality of frames in the sequence, each noise threshold for a particular one of the frames corresponding to a different perceptual coding quality for the particular frame; estimating a bit demand for each of a corresponding one or more perceptual coding qualities for each frame, wherein each estimated bit demand comprises a number of bits which would be used to code a given frame at the corresponding perceptual coding quality; selecting one of the perceptual coding qualities for the coding of a particular frame based upon the estimated bit demand for the perceptual coding quality for the particular frame, and further based on one or more bit demands estimated for one or more other frames; and coding the particular frame based on the noise threshold corresponding to the selected perceptual coding quality for the particular frame. In particular, and in accordance with one illustrative embodiment of the present invention, the average bit demand for coding each of a plurality of frames at each of a plurality of different perceptual coding qualities is advantageously estimated, and based on these estimates, each frame is coded so as to maintain a relatively consistent perceptual coding quality from one frame to the next.

28 Claims, 3 Drawing Sheets

PERCEPTUAL AUDIO CODER BIT ALLOCATION SCHEME PROVIDING IMPROVED PERCEPTUAL QUALITY CONSISTENCY

FIELD OF THE INVENTION

The present invention relates generally to the field of perceptual audio coding (PAC) techniques and more particularly to a bit allocation scheme which achieves relatively consistent perceptual quality across consecutively coded frames.

BACKGROUND OF THE INVENTION

In present state of the art audio coders for use in coding signals representative of, for example, speech and music, for purposes of storage or transmission, perceptual models based on the characteristics of the human auditory system are typically employed to reduce the number of bits required to code a given signal. In particular, by taking such characteristics into account, "transparent" coding (i.e., coding having no perceptible loss of quality) can be achieved with significantly fewer bits than would otherwise be necessary. In such coders, typically known as perceptual audio coders, the signal to be coded is first partitioned into individual frames, with each frame comprising a small time slice of the signal, such as, for example, a time slice of approximately twenty milliseconds. Then, the signal for the given frame is transformed into the frequency domain, typically with use of a filter bank. The resulting spectral coefficients may then be quantized and coded. In particular, the quantizer which is used in a perceptual audio coder to quantize the spectral coefficients is advantageously controlled by a psychoacoustic model (i.e., a model based on the performance of the human auditory system), and by the specific number of bits that are available to code the given frame. An illustrative Perceptual Audio Coder (PAC) is described, for example, in U.S. Pat. No. 5,040,217, issued on Aug. 13,1991 to K. Brandenburg et al., and assigned to the assignee of the present invention. U.S. Pat. No. 5,040,217 is hereby incorporated by reference as if fully set forth herein.

Due to the nature of audio signals and the effects of the psychoacoustic model, the bit demand (i.e., the number of bits requested by the quantizer to code the given frame) typically varies with a large range from frame to frame. Therefore, it is invariably necessary to provide for a bit allocation scheme, which, inter alia, makes sure that the average bit rate remains relatively close to the desired bit rate (e.g., the bit rate of the channel over which the coded signal is ultimately to be transmitted, or the amount of available storage per frame if the coded signal is simply to be stored). In addition, the bit allocation scheme must ensure that the coder's output "bit buffer" or "bit reservoir" (which provides the coder with the bits which are available) never runs empty (which is referred to as an underflow condition) or full (which is referred to as an overflow condition). (The use of a bit buffer or reservoir in audio coders is fully familiar to those of ordinary skill in the art.)

A typical prior art bit allocation scheme is described, for example, in U.S. Pat. No. 5,627, 938, issued on May 6, 1997 to J. Johnston, and assigned to the assignee of the present invention. U.S. Pat. No. 5,627, 938 is hereby incorporated by references as if fully set forth herein. Specifically, this prior art bit allocation scheme operates as follows. Each frame of the signal to be coded is initially coded with quantizer step sizes that are determined by a masked threshold which is computed by the psychoacoustic model. The masked threshold corresponds to a transparent coding quality. That is, setting the quantizer step sizes based on the masked threshold will, in general, provide for a coding which when reconstructed will sound (to the human ear) identical to the original signal.

Given the bit demand of the initially coded frame and the state of the bit buffer (i.e., the degree of "emptiness" or "fullness" thereof), the bit allocation scheme decides how many bits are actually given to the quantizer to code the frame. That is, the bit allocator can be viewed as a controller which controls the number of bits allowed, given both the initial bit demand and the buffer state. Specifically, the quantizer step sizes are then modified in an attempt to match the allowed number of bits, and the frame is then re-coded with the modified step sizes, after which the bit allocator again makes a determination of the number of bits to actually be given to the quantizer. This process iterates until the frame is quantized and coded with a number of bits close to the number actually granted by the bit allocator. (This iterative process is referred to in the audio coding art as the "rate loop," and the processor which performs it is referred to as the "rate loop processor.")

Note that when the average bit demand of successive initially coded frames is either significantly higher or significantly lower than the average overall bit rate of the coder, the performance of this rate loop process is limited by the fact that the bit buffer necessarily has a substantial influence on the bit allocation. As such, the process fails to adequately account for the perceptual impact of the resulting bit allocation. In other words, the bit buffer becomes essentially the sole factor in the decision of how much the allocated number of bits diverge from the actual number of initially demanded bits.

To partially address this problem, prior art audio coders such as PAC employ what is known as a noise threshold, which exceeds the masked threshold by a predetermined amount. Typically, this results in an average bit demand which is closer to the desired bit rate. In this manner, the bit buffer state remains relatively well behaved (i.e., having a low risk of suddenly running empty or of overflowing), and the control task of the bit allocator becomes relatively straightforward.

Clearly, the bit demand of the noise threshold which results in an appropriate given range of average bit demand can be well below the bit rate which would be necessary to achieve transparency. Therefore, one disadvantage of having to use different noise thresholds for different target bit rates is the necessity of manually tuning the psychoacoustic model of the coder for each specific target bit rate, in order to achieve a reasonable level of efficiency and performance. However, since different types of audio signals result in significantly different bit demands, even providing for such a manual tuning process may not result in a coder that works well for all types of audio signals, or even one that works well for a single audio signal having characteristics which change over time. The typical result is that the coder provides a quality level which often varies significantly (over time), due to a failure of the bit allocator to allocate bits to consecutive frames in such a manner so as to ensure that they are coded with a relatively consistent quality level. In fact, this inconsistent behavior becomes more severe with increasing divergence between the target bit rate and the bit demand of the initially coded frames.

SUMMARY OF THE INVENTION

It has been realized that a more consistent perceptual quality over time provides for a far more pleasing auditory experience to the listener. In other words, significant variations in perceptual quality of a reconstructed audio signal is typically even more disconcerting to a listener than a reduced, but nonetheless consistent level of quality would be. It has also been realized that to provide a consistent perceptual quality over time, it is not sufficient to allow the bit allocation process to be controlled by merely the frame's initial bit demand and the state of the bit buffer. Rather, in accordance with the principles of the present invention, the bit allocation process is further controlled by taking into account the characteristics of a plurality of frames and by analyzing the bit requirements of coding each of these frames at various levels of perceptual quality.

More specifically, the present invention provides a method (and apparatus) for coding an audio signal, the method comprising the steps of partitioning the audio signal into a sequence of successive frames; calculating one or more noise thresholds for each of a plurality of frames in the sequence, each noise threshold for a particular one of the frames corresponding to a different perceptual coding quality for the particular frame; estimating a bit demand for each of a corresponding one or more perceptual coding qualities for each frame, wherein each estimated bit demand comprises a number of bits which would be used to code a given frame at the corresponding perceptual coding quality; selecting one of the perceptual coding qualities for the coding of a particular frame based upon the estimated bit demand for the perceptual coding quality for the particular frame, and further based on one or more bit demands estimated for one or more other frames; and coding the particular frame based on the noise threshold corresponding to the selected perceptual coding quality for the particular frame. In particular, and in accordance with one illustrative embodiment of the present invention, the average bit demand for coding each of a plurality of frames at each of a plurality of different perceptual qualities is advantageously estimated, and based on these estimates, each frame is coded so as to maintain a relatively consistent perceptual quality from one frame to the next.

DETAILED DESCRIPTION

Bit Allocation in a Conventional Perceptual Audio Coder

Figure 1:
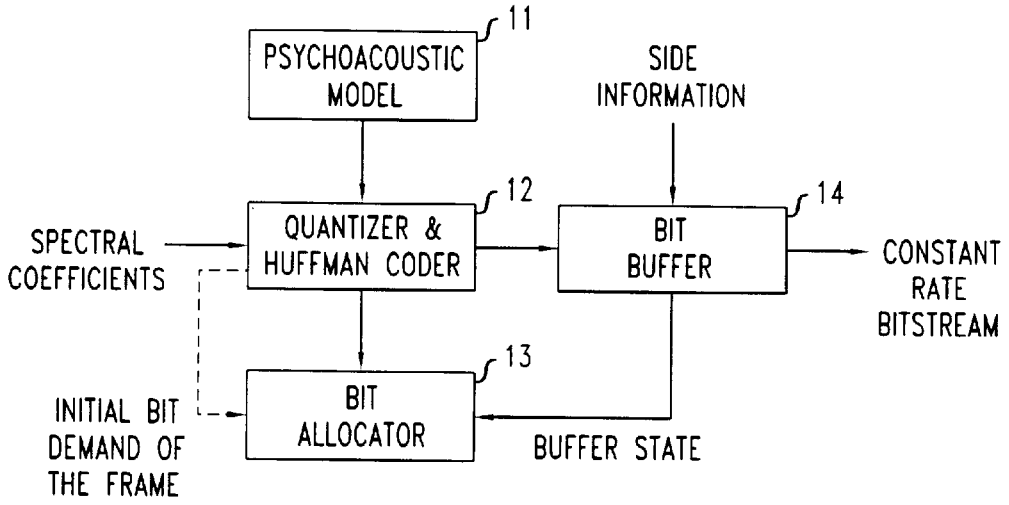
FIG. 1 (PRIOR ART)
FIG. 1 shows an overview of the bit allocation portion of an illustrative conventional prior art audio coder such as PAC.

FIG. 1 shows an overview of the bit allocation portion of an illustrative conventional prior art audio coder such as PAC. The figure shows psychoacoustic model 11, quantizer and Huffman coder 12, bit allocator 13 and bit buffer 14. As explained above. psychoacoustic model 11 provides masked thresholds which are used by the quantizer (of quantizer and Huffman coder 12) to determine quantization step sizes which initially provide for transparent coding of the given frame of the audio signal. Based on these step sizes, the spectral coefficients of the given frame are quantized and the resultant data is Huffman coded by quantizer and Huffman coder 12, which results in an initial bit demand (i.e., the number of bits which would be required by the resultant encoding). This bit demand is provided to bit allocator 13, which is aware of the required bit rate (i.e., the rate of the constant rate bitstream which is to be ultimately output by bit buffer 14).

Meanwhile, bit buffer 14 provides the buffer state (i.e., the degree of fullness or emptiness) to bit allocator 13. If the initial bit demand is consistent with the buffer state and the given required bit rate, the frame is coded with the given encoding (as determined by quantizer and Huffman coder 12), but if it is not (as is most typical), quantizer and Huffman coder 12 is instructed by bit allocator 13 to re-code the frame with different quantization step sizes, and the process iterates until a bit demand consistent with the buffer state and the given required bit rate is achieved.

Figure 2:
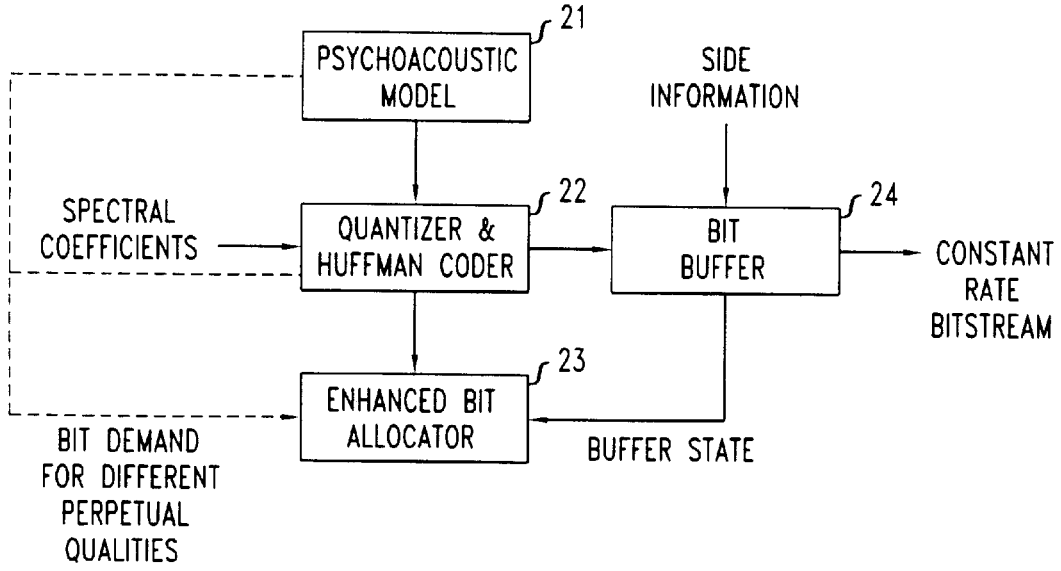
FIG. 2 shows an overview of the bit allocation portion of a perceptual audio coder in accordance with an illustrative embodiment of the present invention.

An Illustrative Novel Bit Allocation Scheme for a Single Perceptual Audio coder FIG. 2 shows an overview of the bit allocation portion of a perceptual audio coder in accordance with an illustrative embodiment of the present invention. The figure shows psychoacoustic model 21, quantizer and Huffman coder 22, enhanced bit allocator 23, and bit buffer 24. In accordance with an illustrative embodiment of the present invention, when a given frame is provided to the coder for coding, psychoacoustic model 21 provides one or more noise thresholds (i.e., the masked threshold with a given amount of additional noise added thereto) representing one or more corresponding perceptual qualities therefor. For example, in one illustrative embodiment of the present invention, psychoacoustic model may, for example, provide a threshold representing a transparent perceptual quality for the given frame, and several other thresholds representing successively lower perceptual qualities.

Based on the one or more noise thresholds provided by psychoacoustic model 21, quantizer and Huffman coder 22 determines corresponding bit demands for the various different perceptual qualities. In particular, each of these thresholds translate into particular quantization step sizes, and based on these step sizes, the spectral coefficients of the given frame are quantized and the resultant data is Huffman coded by quantizer and Huffman coder 12, which results in a set of bit demands corresponding to the various perceptual qualities. Then, enhanced bit allocator 23 determines at which perceptual quality level the given frame is to be coded.

The selection of a perceptual quality level at which to code the given frame is advantageously based upon a number of factors. These include the required bit rate (i.e., the rate of the constant rate bitstream which is to be ultimately output by bit buffer 24); the state of the bit buffer (as provided to it by bit buffer 24); the various bit demands required to code the given frame at each of the various perceptual qualities (as determined by quantizer and Huffman coder 22); and, in accordance with the principles of the present invention, an analysis of the bit demands at one or more perceptual qualities for one or more other frames. These other frames may, for example, advantageously include a number of frames previous to the given frame (i.e., "past" frames) and/or a number of frames subsequent to the given frame (i.e., "future" frames).

Figure 3:
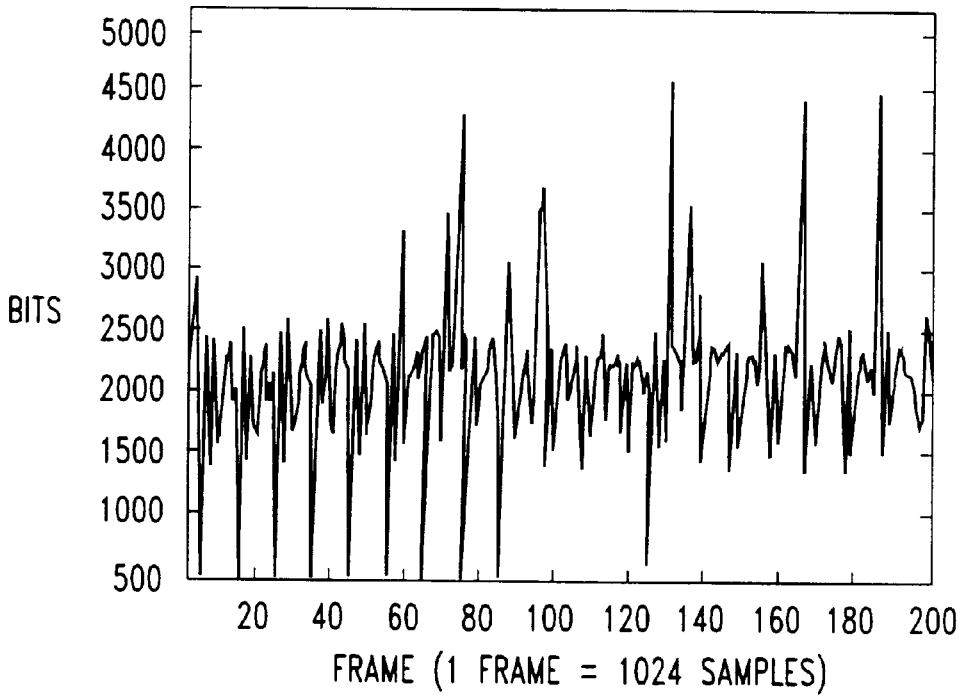
FIG. 3 shows a graphical illustration of the bit demand as a function of time at a constant perceptual quality for a typical perceptual audio coder applied to a typical stereo audio signal.

FIG. 3 shows a graphical illustration of the bit demand as a function of time at a constant perceptual quality for a typical perceptual audio coder applied to a typical stereo audio signal. For the example shown, the average bit rate is 68 kilobits per second, with a 32 kilohertz sampling rate for a stereo signal. In general, the bit demand b(k, Q) is a function of time k (the frame number) and the perceptual quality Q, where Q is typically a number that monotonically increases as the perceived quality increases. Ideally, a perceptual audio coder runs at a relatively constant perceptual quality Q because short bursts of low quality audio tend to reduce the perceived quality of the overall signal. But the bit demand for a constant perceptual quality can vary substantially from frame to frame, as shown illustratively in FIG. 3, due to variations in the given frame's signal energy and due to variations in the amount of both irrelevancy reduction and relevancy reduction achieved by the coding process. In accordance with the present invention, the bits are advantageously allocated such that successive frames are coded at a relatively constant perceptual quality under the given constraints of the average bit rate and the size of the bit buffer.

Figure 4:
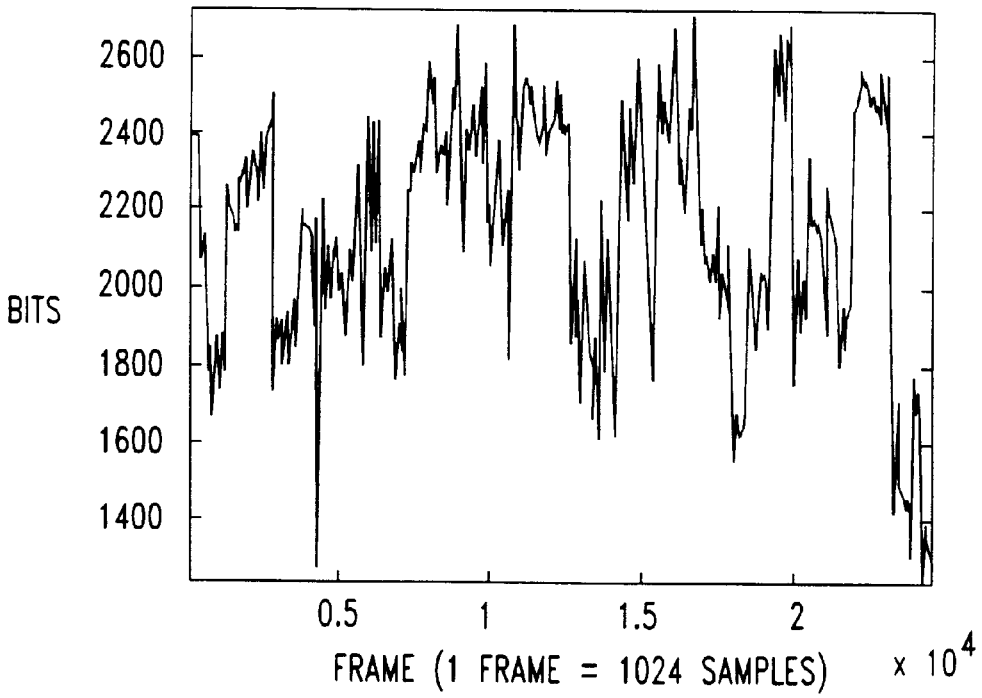
FIG. 4 shows a graphical illustration of an averaged bit demand as a function of time at a constant perceptual quality for a typical perceptual audio coder applied to a given sequence of audio clips.

Note that when viewed over a relatively long time span the bit demand for a constant perceptual quality is not stationary in the sense that its mean is not constant. However, when viewed over a relatively short time span, such as, for example, 400 milliseconds or 20 frames (each frame being typically 20 milliseconds), the bit demand has a fairly constant mean, changing relatively slowly over time. FIG. 4 shows a graphical illustration of an averaged bit demand as a function of time at a constant perceptual quality for a typical perceptual audio coder applied to a sequence of audio clips. The illustrative sequence comprises approximately 25 music and speech clips lasting approximately 15 minutes. Note from the figure that different clips have differing averaged bit demands. Therefore, given an output bit buffer of a relatively modest size, a perceptual audio coder is not likely to be able to code a series of such clips with a constant perceptual quality.

Thus, in accordance with an illustrative embodiment of the present invention, for each audio frame k, the perceptual quality Q(k) is adapted over time. Two conditions are advantageously applied to such an adaptation. First, the average demand is advantageously maintained at a value close to the desired bit rate. And second, the perceptual quality is advantageously permitted to change only slowly from frame to frame. Thus, the performance of the illustrative embodiment of the present invention at least approximates the "ideal" scenario of maintaining a constant perceptual quality.

Specifically, noting that the average bit demand for a given perceptual quality Q is relatively constant over the short term, we can advantageously estimate the mean bit demand m(k, Q) at each time (i. e., frame) k using, in general, a weighted average of future and past bit demand values, as follows:

$$m(k, Q) = \sum_{i=-K}^{L} w(i)b(k-i, Q) \tag{1}$$

In particular, vector w(i) comprises a weighting vector for estimating the mean bit demand, which in various illustrative embodiments of the present invention may weight the computed mean value towards the bit demands of those frames which are more proximate to the given frame. In other illustrative embodiments, the weighting vector may comprise a simple square window (thereby delineating a particular subsequence of consecutive frames whose bit demand contributes to the computation)—e.g., w(i)=1, for $-K \leqq i \leqq L$. Note also that L is the number of frames previous to the given frame (i.e., the past frames) and K is the number of frames subsequent to the given frame (i. e., the future frames) whose bit demand values are taken into account in computing the mean bit demand, m(k, Q). In one illustrative embodiment of the present invention, K=0, in which case only past frames are taken into account. This simplifies the process significantly (since no "look ahead" is required), but nonetheless does not appear to limit the performance of the novel bit allocation process significantly (if at all).

Given different types of audio signals, or even given different portions of a specific music signal, the average bit demand may vary significantly. Thus, in accordance with an illustrative embodiment of the present invention, the perceptual quality at which each given frame is coded is updated based on the current conditions. In particular, at each time (i.e.,. frame) k, we advantageously calculate the perceptual quality Q(k) at which the estimated mean bit demand m(k, Q) is equal to the average number of bits B which are available for each frame at the desired bit rate, as follows:

$$m(k, Q(k))=B \tag{2}$$

Note that given the quality Q(k) which satisfies equation (2), we may advantageously allocate b(k, Q(k)) bits to code frame k. Given that a sufficiently large estimation window is chosen (i.e., the bit demands for a sufficient number of past and/or future frames are included in the computation of the mean bit demand for use in coding the given frame), the perceptual quality Q(k) will advantageously change slowly over time (i.e., as k increases). In accordance with certain other illustrative embodiments of the present invention, additional restrictions which would be obvious to those skilled in the art could be imposed to prevent Q(k) from changing too rapidly. For example, a maximum rate of change criterion for the perceptual quality may be easily integrated into the above-described scheme by one of ordinary skill in the art.

And in addition, in accordance with various illustrative embodiments of the present invention, conventional bit buffer control may also be employed to ensure that the bit buffer does not run empty or full. However, due to the fact that the instant inventive technique (in accordance with the various illustrative embodiments described herein) typically ensures that the bit allocation tracks fairly close to the given bit rate, such bit buffer control is likely to have only a minor influence on the resultant bit allocation.

An Illustrative Novel Bit Allocation Scheme for Multiple Perceptual Audio Coders In accordance with another illustrative embodiment of the present invention, the bit allocation scheme described above can be advantageously extended to provide for simultaneous bit allocation over N perceptual audio coders which run in parallel. Such multiple audio coders may, for example, be used to code a plurality of independent audio programs, or they may be used to code multiple channels of the same program. In accordance with such an illustrative embodiment, the joint mean bit demand of the multiple (e.g., N) audio coders may be advantageously estimated over time, as follows:

$$m(k, Q) = \sum_{i=1}^{N} \sum_{i=-K}^{L} w(i, j) b_i(k - i, Q) \quad (3)$$

In this manner, the perceptual quality Q(k) is advantageously computed at each point in time k such that the estimated mean bit demand m(k, Q(k)) as computed above is equal or nearly equal to the average number of bits per frame B at the given bit rate, as shown in equation (2). Then, the perceptual quality Q(k) is the quality at which all N of the audio coders code the given frame—that is, for each of the N audio coders $j=\{1, 2, \ldots, N\}$, $b_j(k, Q(k))$ bits are allocated to its corresponding frame k.

An Illustrative Relationship Between Bit Demand and Perceptual Quality

In accordance with various illustrative embodiments of the present invention, the different perceptual qualities (Q) may be defined in any of a number of ways, many of which would be obvious to those of ordinary skill in the art. In accordance with one illustrative embodiment, for example, a psychoacoustic model which computes a noise level (i.e., a noise threshold) for each possible perceptual quality (or for a fixed number of possible perceptual qualities) may be derived based on conventional techniques involving, for example, psychoacoustic experimentation. Alternatively, in accordance with other illustrative embodiments, noise may be systematically added to the masked threshold (as presently computed by conventional psychoacoustic models) in order to estimate a noise threshold corresponding to a desired perceptual quality. Such "enhanced" psychoacoustic models can themselves be implemented in a number of ways, many of which will be obvious to those skilled in the art.

In accordance with one illustrative embodiment, for example, a relatively simple implementation of multiple perceptual qualities (i.e., one requiring only minimal modifications to a conventional PAC coder) may be obtained by merely assuming that two frames are being coded at the same perceptual quality if their masked thresholds are increased or decreased by the same offset (to thereby produce corresponding noise thresholds)—specifically, to decrease the perceptual quality of two frames by the same amount, their corresponding masked thresholds may be advantageously made higher by the same offset in a logarithmic scale (i.e., the same factor on a linear scale). Given such a modified masked threshold, the signal for the given frame can be coded in order to compute the number of bits required for a given perceptual quality—namely, the bit demand, b(k, Q). However, due to the fact that it is computationally intensive to compute such bit demands for a very large number of possible perceptual qualities, in accordance with certain illustrative embodiments of the present invention, the computational complexity is advantageously reduced with the use of either of the two following implementation schemes.

Figure 5:
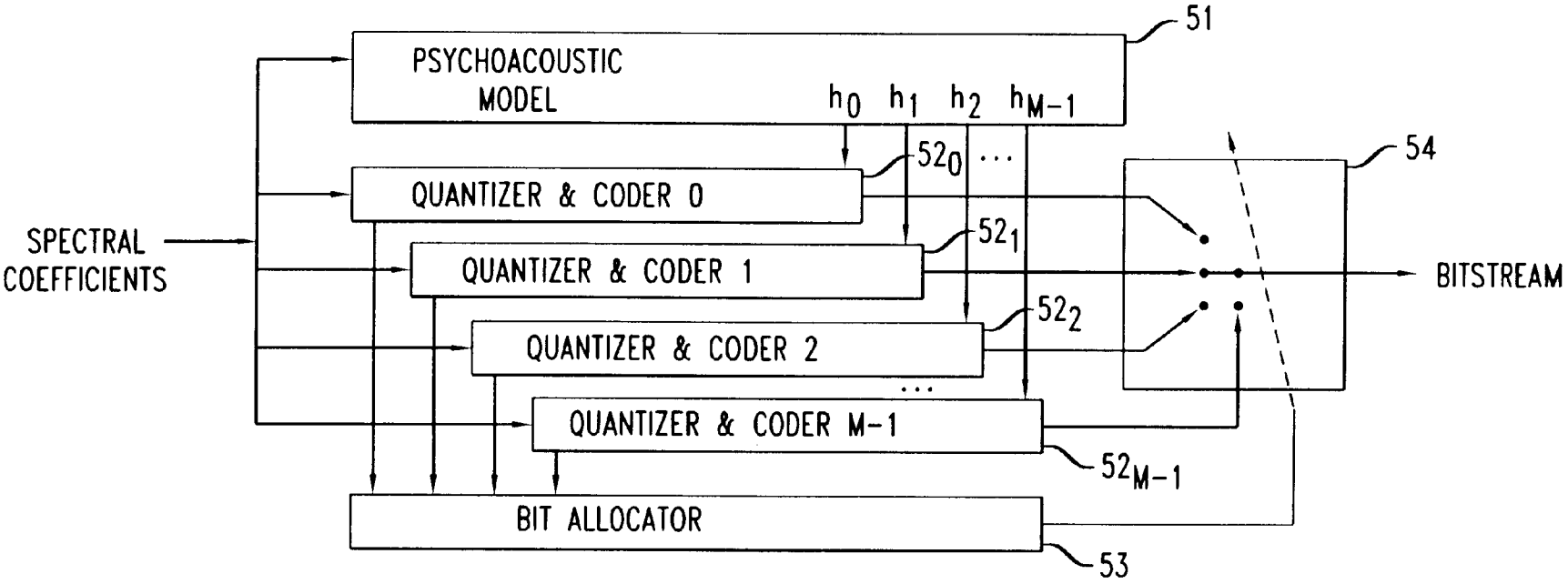
FIG. 5 shows an implementation of a bit allocation scheme employing a set of discrete perceptual qualities in accordance with a first illustrative embodiment of the present invention.

A First Illustrative Implementation Employing a Set of Discrete Perceptual Qualities FIG. 5 shows an implementation of a bit allocation scheme employing a set of discrete perceptual qualities in accordance with a first illustrative embodiment of the present invention. Specifically, for each frame, only a relatively small set of bit demands are advantageously computed, one for each of a small number of discrete perceptual qualities.

Specifically, a limited number of discrete perceptual qualities are predetermined as corresponding to a certain offset of the masking threshold (or, more generally, to the masked threshold with a certain amount of additional noise), as described above. Moreover, these offsets are advantageously set based on the bit rate and the system designer's expectations of the system's performance. For example, for relatively high bit rates, where transparent coding can sometimes be achieved, the "highest" perceptual quality may be set to a fully transparent quality (e.g., by using the original masking threshold), and each successively lower quality may be set to be "less transparent" than the previous one by an approximately equal amount. On the other hand, for lower bit rates where transparency is not expected to occur, one of the "middle" perceptual qualities might be advantageously chosen to be the average "expected" quality, with higher and lower quality levels being approximately equally spaced successively above and successively below the average quality level, respectively.

In particular, in accordance with the first illustrative embodiment of the present invention, for each frame k, the bit demand $b(k, Q_j)$ at each of a set of M predetermined discrete perceptual qualities ($0 \leqq j < M$) is computed as follows. A quantization noise threshold $n_j$ for a specific perceptual quality $Q_j$ is computed by the psychoacoustic model as described above. Then, the spectral coefficients for the given frame k are quantized with a quantization error corresponding to $n_j$, Huffman coded, and the corresponding bit demand $b(k, Q_j)$ is calculated for each j.

With specific reference to FIG. 5, psychoacoustic model 51 produces M distinct noise thresholds $n_0$ through $n_{M-1}$, and provides each of these to a corresponding quantizer and coder, $\mathbf{52}_0$ through $\mathbf{52}_{M-1}$, each of which quantizes and codes the spectral coefficients for each of a plurality of frames at the corresponding perceptual quality level. Then, for each frame k, bit allocator 53 chooses the quality $Q_j$ which most closely satisfies Equation (2), allocates $b(k, Q_j)$ bits to the frame, and directs switch 54 to provide the encoding produced by quantizer and coder $\mathbf{52}_j$ to the encoded bitstream.

In accordance with the first illustrative embodiment, to ensure that the bit demands at the computed perceptual qualities are within the range of the bit rate, the levels of the perceptual qualities are advantageously adapted slowly over time. For example, this may be implemented by advantageously choosing the best quality $Q_0$ (adaptively) such that the long term mean of the bit demand at $Q_0$ is slightly higher than the average number of bits per frame B at the desired bit rate. Similarly, the lowest quality $Q_{M-1}$ may be advantageously chosen such that the estimated mean bit demand (Equation (1)) never or at most rarely exceeds B. The quality levels in between $Q_0$ and $Q_{M-1}$ may then be perceptually equally spaced therebetween.

Additionally, however, an "escape" quality $Q_E$ may also be advantageously provided in order to provide additional assurance that the bit buffer does not run empty (i.e., so that no bits are available to code subsequent frames). In particular, the escape quality $Q_E$ is chosen to be well below the other perceptual qualities. and bit allocator 53 selects this quality to code the given frame any time the bit buffer runs dangerously low. (In practice, however, such a selection will need to be made rarely, if ever.)

Note that the scheme in accordance with the first illustrative embodiment of the present invention eliminates the need for a rate loop as employed in typical prior art perceptual audio coders. By providing for a fixed, but limited number of different perceptual qualities, the process not only results in a well controlled bit allocation and thereby improved perceptual performance, but it is also ensured to require at most a fixed number of iterations. As such, the degree to which the computational load varies in the resulting coder is significantly reduced as compared to that of a conventional prior art audio coder, thus making the implementation easier, particularly for real-time applications.

A Second Illustrative Implementation Employing Estimated Bit Demands

In accordance with a second illustrative embodiment of the present invention, the bit demand for different perceptual qualities is estimated without actually coding and counting the number of bits used. With use of a simple approximation, a rough estimation of the bit demand b(k, Q) may be obtained, and based on this estimation, the quality level to be used for the coding of each frame is selected.

Specifically, note first that the bit demand b(k, Q) consists of side information s(k) and the bits that actually represent the spectral coefficients h(k) (the Huffman bits). This may be represented mathematically as follows:

$$b(k, Q)=s(k)+h(k, Q) \tag{4}$$

For the sake of the present approximation (in accordance with the second illustrative embodiment of the present invention), assume that the coding of two frames change perceptually equally in quality if the number of Huffman bits are proportionally equally changed given the bit demand for one particular quality level, for example, Q=1.0. Therefore, the bit demand for a specific quality Q>0 can be estimated given the actual bit demand at quality Q=1.0, as follows:

$$b(k, Q)=s(k)+h(k, 1.0)Q=(b(k, 1.0)-s(k))Q+s(k) \tag{5}$$

By using a simple square window, $$w(i) = \frac{1}{K+L+1} \quad \text{for } -K \le i \le L \tag{6}$$

and w(i)=0 otherwise, and by assuming that the side information is constant (s(k)=s), the estimated mean demand from Equation (1) becomes $$m(k, Q) = \frac{Q}{K+L+1}\left(\sum_{i=-K}^{L} b(k-i, 1.0) - s\right) + s. \tag{7}$$

Given the condition of Equation (2), the quality Q(k) for each frame k can then be computed as follows:

$$Q(k) = \frac{B-s}{m(k, 1.0)-s} \tag{8}$$

And for each frame k, we can allocate the number of bits corresponding to the quality Q(k) as follows:

$$b(k) = b(k, Q(k)) = \frac{B-s}{m(k, 1.0)-s} b(k, Q = 1.0), \tag{9}$$

which satisfies the condition of Equation (2). Specifically, in accordance with the second illustrative embodiment of the present invention, the rate loop (similar to that of an otherwise conventional perceptual audio coder) can be made to iterate (changing the quantizer step sizes) until approximately b(k) bits are used to code frame k.

Note that the implementation in accordance with this second illustrative embodiment can be advantageously integrated into an existing audio coder with only minimal modifications thereto. Clearly, since this implementation uses only a simple formula to estimate the bit demand as a function of perceptual quality, it is likely to be less perceptually controlled than, for example, the implementation in accordance with the first illustrative embodiment described above. However, the simplicity of this approach, and the ease with which an existing coder can be modified to use it, offer certain advantages.

Note also that in accordance with other illustrative embodiments of the present invention, aspects of the first illustrative embodiment and aspects of the second illustrative embodiment may be combined in ways which will be obvious to those of ordinary skill in the art. For example, the bit demand may be estimated as a function of perceptual quality by computing a few data points (as is done by the above-described first illustrative embodiment), and then a more "precise" quality level choice may be advantageously obtained by interpolating in between two of these data points (in accordance with the approach of the second illustrative embodiment). In other words, an iterative rate loop which limits its iterations to be between two pre-calculated perceptual qualities may be used to obtain certain of the advantages of both the first and second illustrative embodiments as described above.

Addendum to the Detailed Description

The preceding merely illustrates the principles of the invention. It will thus be appreciated that those skilled in the art will be able to devise various arrangements which, although not explicitly described or shown herein, embody the principles of the invention and are included within its spirit and scope. For example, the principles of the present invention may be applied to any form of source coding in which the bit demand varies from frame to frame and is based on perceptual criteria, such as, for example, video coding. Furthermore, all examples and conditional language recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future—i.e., any elements developed that perform the same function, regardless of structure.

Thus, for example, it will be appreciated by those skilled in the art that the block diagrams herein represent conceptual views of illustrative circuitry embodying the principles of the invention. Similarly, it will be appreciated that any flow charts, flow diagrams, state transition diagrams, pseudocode, and the like represent various processes which may be substantially represented in computer readable medium and so executed by a computer or processor, whether or not such computer or processor is explicitly shown.

The functions of the various elements shown in the figures, including functional blocks labeled as "processors" or "modules" may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" should not be construed to refer exclusively to hardware capable of executing software, and may implicitly include, without limitation, digital signal processor (DSP) hardware, read-only memory (ROM) for storing software, random access memory (RAM), and non-volatile storage. Other hardware, conventional and/or custom, may also be included. Similarly, any switches shown in the FIGS. are conceptual only. Their function may be carried out through the operation of program logic, through dedicated logic, through the interaction of program control and dedicated logic, or even manually, the particular technique being selectable by the implementor as more specifically understood from the context.

In the claims hereof any element expressed as a means for performing a specified function is intended to encompass any way of performing that function including, for example, (a) a combination of circuit elements which performs that function or (b) software in any form, including, therefore, firmware, microcode or the like, combined with appropriate circuitry for executing that software to perform the function. The invention as defined by such claims resides in the fact that the functionalities provided by the various recited means are combined and brought together in the mainer which the claims call for. Applicant thus regards any means which can provide those functionalities as equivalent (within the meaning of that term as used in 35 U.S.C. 112, paragraph 6) to those explicitly shown and described herein.

What is claimed is:

1. A method of coding a signal based on a perceptual model, the method comprising the steps of:

partitioning the signal into a sequence of successive frames;

calculating one or more noise thresholds for each of a plurality of said frames in said sequence, each noise threshold for a particular one of said frames corresponding to a different perceptual coding quality for said particular one of said frames;

estimating a bit demand for each of a corresponding one or more of said perceptual coding qualities for each of said plurality of said frames, wherein each estimated bit demand comprises a number of bits which would be used to code a given one of said frames at said corresponding perceptual coding quality;

selecting one of said perceptual coding qualities for the coding of a particular one of said frames based upon the estimated bit demand for said perceptual coding quality for said particular one of said frames and further based on one or more bit demands estimated for one or more other ones of said frames; and coding said particular one of said frames based on the noise threshold corresponding to said selected one of said perceptual coding qualities for said particular one of said frames.

2. The method of claim 1 wherein said signal comprises an audio signal and said perceptual model comprises a psychoacoustic model.

3. The method of claim 2 wherein each of said successive frames comprises a time segment of said signal, each of said time segments having a duration of approximately 20 milliseconds.

4. The method of claim 2 wherein said different perceptual coding qualities include a perceptually transparent coding quality, and wherein the noise threshold of the frame which corresponds to said perceptually transparent coding quality comprises a masking threshold for said frame.

5. The method of claim 2 wherein one or more of said one or more noise thresholds for a given frame is calculated by modifying a masking threshold of said given frame by a multiple of a predetermined fixed offset.

6. The method of claim 2 wherein the coding of the signal is to be performed based on a predetermined bit rate, and wherein said one or more noise thresholds for each of said frames is calculated based on said predetermined bit rate.

7. The method of claim 2 wherein said estimation of a bit demand for a particular one of said perceptual coding qualities for a given one of said frames comprises:

deriving one or more quantization step sizes based on said noise threshold corresponding to said particular perceptual coding quality for said given frame;

coding said given frame based on said derived quantization step sizes to produce a set of quantized values;

performing a Huffman coding of said set of quantized values; and calculating a number of bits based on said Huffman coding of said set of quantized values.

8. The method of claim 2 wherein said estimation of a bit demand for a particular one of said perceptual coding qualities for a given one of said frames comprises calculating an approximation of said bit demand based on a predetermined formula.

9. The method of claim 8 wherein said step of selecting said one of said perceptual coding qualities comprises:

deriving one or more quantization step sizes based on said noise threshold corresponding to said particular perceptual coding quality for said given frame;

coding said given frame based on said derived quantization step sizes to produce a set of quantized values;

performing a Huffman coding of said set of quantized values;

calculating a number of bits based on said Huffman coding of said set of quantized values; and repeating, zero or more times, said steps of deriving one or more quantization step sizes, coding said given frame, performing said Huffman coding, and calculating said number of bits, until said calculated number of bits is within a predetermined amount of said approximation of said bit demand.

10. The method of claim 2 wherein the step of selecting one of said perceptual coding qualities is based on a mean bit demand comprising a mathematical average of a plurality of said estimated bit demands for each of said one or more of said perceptual coding qualities for a corresponding plurality of said frames, said corresponding plurality of said frames including said particular one of said frames and further including at least one of said other ones of said frames previous to said particular one of said frames in said sequence of successive frames.

11. The method of claim 10 further comprising the step of coding a frame immediately previous to said particular one of said frames in said sequence of successive frames at a previously selected perceptual coding quality, and wherein the step of selecting one of said perceptual coding qualities for the coding of the particular one of said frames comprises selecting a perceptual coding quality which differs by less than a predetermined amount from said previously selected perceptual coding quality.

12. The method of claim 1 wherein said method employs a bit buffer for use in allocating bits for said coding of said signal, and wherein said step of selecting one of said perceptual coding qualities for the coding of said particular one of said frames is further based on a measure of fullness of said bit buffer determined after a frame immediately previous to said particular one of said frames in said sequence of successive frames has been coded.

13. The method of claim 1 further comprising the step of coding one or more additional signals, the signal and said additional signals each being partitioned into corresponding sequences of corresponding successive frames, wherein the step of selecting one of said perceptual coding qualities for the coding of said particular one of said frames is further based on one or more bit demands which have been estimated for one or more frames of said one or more additional signals which correspond to said particular one of said frames.

14. The method of claim 13 wherein the step of selecting one of said perceptual coding qualities is based on a mean bit demand comprising a mathematical average of a plurality of said estimated bit demands for each of said one or more of said perceptual coding qualities for a corresponding plurality of said frames of the signal and for a corresponding plurality of said corresponding frames of said one or more additional signals, said corresponding plurality of said frames of the signal and said corresponding plurality of said corresponding frames of said one or more additional signals each including said particular one of said frames, and each further including at least one of said other ones of said frames previous to said particular one of said frames in said sequence of successive frames of the signal and in said corresponding sequences of corresponding successive frames of said additional signals.

15. An apparatus for coding a signal based on a perceptual model, the apparatus comprising:

means for partitioning the signal into a sequence of successive frames;

means for calculating one or more noise thresholds for each of a plurality of said frames in said sequence, each noise threshold for a particular one of said frames corresponding to a different perceptual coding quality for said particular one of said frames;

means for estimating a bit demand for each of a corresponding one or more of said perceptual coding qualities for each of said plurality of said frames, wherein each estimated bit demand comprises a number of bits which would be used to code a given one of said frames at said corresponding perceptual coding quality;

means for selecting one of said perceptual coding qualities for the coding of a particular one of said frames based upon the estimated bit demand for said perceptual coding quality for said particular one of said frames and further based on one or more bit demands estimated for one or more other ones of said frames; and means for coding said particular one of said frames based on the noise threshold corresponding to said selected one of said perceptual coding qualities for said particular one of said frames.

16. The apparatus of claim 15 wherein said signal comprises an audio signal and said perceptual model comprises a psychoacoustic model.

17. The apparatus of claim 16 wherein each of said successive frames comprises a time segment of said signal, each of said time segments having a duration of approximately 20 milliseconds.

18. The apparatus of claim 16 wherein said different perceptual coding qualities include a perceptually transparent coding quality, and wherein the noise threshold of the frame which corresponds to said perceptually transparent coding quality comprises a masking threshold for said frame.

19. The apparatus of claim 16 wherein one or more of said one or more noise thresholds for a given frame is calculated by modifying a masking threshold of said given frame by a multiple of a predetermined fixed offset.

20. The apparatus of claim 16 wherein the coding of the signal is to be performed based on a predetermined bit rate, and wherein said one or more noise thresholds for each of said frames is calculated based on said predetermined bit rate.

21. The apparatus of claim 16 wherein said means for estimating a bit demand for a particular one of said perceptual coding qualities for a given one of said frames comprises:

means for deriving one or more quantization step sizes based on said noise threshold corresponding to said particular perceptual coding quality for said given frame;

means for coding said given frame based on said derived quantization step sizes to produce a set of quantized values;

means for performing a Huffman coding of said set of quantized values; and means for calculating a number of bits based on said Huffman coding of said set of quantized values.

22. The apparatus of claim 16 wherein said means for estimating a bit demand for a particular one of said perceptual coding qualities for a given one of said frames comprises means for calculating an approximation of said bit demand based on a predetermined formula.

23. The apparatus of claim 22 wherein said means for selecting said one of said perceptual coding qualities comprises:

means for deriving one or more quantization step sizes based on said noise threshold corresponding to said particular perceptual coding quality for said given frame;

means for coding said given frame based on said derived quantization step sizes to produce a set of quantized values;

means for performing a Huffman coding of said set of quantized values;

means for calculating a number of bits based on said Huffman coding of said set of quantized values; and means for applying, one or more times, said means for deriving one or more quantization step sizes, said means for coding said given frame, said means for performing said Huffman coding, and said means for calculating said number of bits, until said calculated number of bits is within a predetermined amount of said approximation of said bit demand.

24. The apparatus of claim 16 wherein the means for selecting one of said perceptual coding qualities is based on a mean bit demand comprising a mathematical average of a plurality of said estimated bit demands for each of said one or more of said perceptual coding qualities for a corresponding plurality of said frames, said corresponding plurality of said frames including said particular one of said frames and further including at least one of said other ones of said frames previous to said particular one of said frames in said sequence of successive frames.

25. The apparatus of claim 24 further comprising means for coding a frame immediately previous to said particular one of said frames in said sequence of successive frames at a previously selected perceptual coding quality, and wherein the means for selecting one of said perceptual coding qualities for the coding of the particular one of said frames comprises means for selecting a perceptual coding quality which differs by less than a predetermined amount from said previously selected perceptual coding quality.

26. The apparatus of claim 15 wherein further comprising a bit buffer for use in allocating bits for said coding of said signal, and wherein said means for selecting one of said perceptual coding qualities for the coding of said particular one of said frames is further based on a measure of fullness of said bit buffer determined after a frame immediately previous to said particular one of said frames in said sequence of successive frames has been coded.

27. The apparatus of claim 15 further comprising means for coding one or more additional signals, the signal and said additional signals each being partitioned into corresponding sequences of corresponding successive frames, wherein the means for selecting one of said perceptual coding qualities for the coding of said particular one of said frames is further based on one or more bit demands which have been estimated for one or more frames of said one or more additional signals which correspond to said particular one of said frames.

28. The apparatus of claim 27 wherein the means for selecting one of said perceptual coding qualities is based on a mean bit demand comprising a mathematical average of a plurality of said estimated bit demands for each of said one or more of said perceptual coding qualities for a corresponding plurality of said frames of the signal and for a corresponding plurality of said corresponding frames of said one or more additional signals, said corresponding plurality of said frames of the signal and said corresponding plurality of said corresponding frames of said one or more additional signals each including said particular one of said frames, and each further including at least one of said other ones of said frames previous to said particular one of said frames in said sequence of successive frames of the signal and in said corresponding sequences of corresponding successive frames of said additional signals.

* * * * *